US011293229B2

(12) United States Patent
Nanayakkara et al.

(10) Patent No.: US 11,293,229 B2
(45) Date of Patent: Apr. 5, 2022

(54) AUTONOMOUSLY DRIVEN ROTARY STEERING SYSTEM

(71) Applicant: Halliburton Energy Services, Inc., Houston, TX (US)

(72) Inventors: Ravi P. Nanayakkara, Kingwood, TX (US); Mukul Agnihotri, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 12 days.

(21) Appl. No.: 16/769,753

(22) PCT Filed: Mar. 27, 2018

(86) PCT No.: PCT/US2018/024627

§ 371 (c)(1),
(2) Date: Jun. 4, 2020

(87) PCT Pub. No.: WO2019/190484

PCT Pub. Date: Oct. 3, 2019

(65) Prior Publication Data

US 2020/0392791 A1 Dec. 17, 2020

(51) Int. Cl.
*E21B 7/06* (2006.01)

(52) U.S. Cl.
CPC ..... *E21B 7/06* (2013.01)

(58) Field of Classification Search
CPC ..... E21B 7/06; E21B 3/00; E21B 21/10
See application file for complete search history.

(56) References Cited

U.S. PATENT DOCUMENTS 6,092,610 A * 7/2000 Kosmala ..... E21B 4/20 175/61
6,997,271 B2 * 2/2006 Nichols ..... E21B 17/00 175/24
2007/0221409 A1 9/2007 Hall et al.
2011/0120725 A1 5/2011 Downtown et al.
2014/0354081 A1 * 12/2014 Li ..... E21B 41/0085 307/126
2015/0337598 A1 * 11/2015 Rushton ..... E21B 10/322 175/57

(Continued)

FOREIGN PATENT DOCUMENTS

WO 2017-065738 A1 4/2017

OTHER PUBLICATIONS

International Search Report and Written Opinion dated Dec. 26, 2018; International PCT Application No. PCT/US2018/024627.

*Primary Examiner* — Benjamin F Fiorello
(74) *Attorney, Agent, or Firm* — McGuireWoods LLP

(57) ABSTRACT

The disclosed embodiments include systems and methods to improve downhole drilling. A representative system may include a geostationary portion (e.g. a valve assembly) and a turbine coupled to the geostationary portion to cause counter-rotation of the geostationary portion relative to a drillstring in a default state. A generator that is also operable to act as a motor is coupled to the turbine, and is also coupled to a controller and an energy that may harness any excess energy generated by the turbine when the turbine is able to counter-rotate the geostationary portion at a faster rate than needed to maintain the geostationary portion in a rotationally static condition relative to the wellbore.

20 Claims, 3 Drawing Sheets

(56) References Cited

U.S. PATENT DOCUMENTS

| | | | | |
|---|---|---|---|---|
| 2015/0337601 | A1 | 11/2015 | Niina et al. | |
| 2017/0030183 | A1* | 2/2017 | Smith | E21B 3/00 |
| 2017/0260841 | A1* | 9/2017 | Nanayakkara | E21B 44/005 |
| 2018/0252042 | A1* | 9/2018 | Nanayakkara | E21B 4/04 |
| 2019/0085640 | A1* | 3/2019 | Vorhoff | E21B 7/06 |
| 2019/0169973 | A1* | 6/2019 | Smith | E21B 44/005 |

* cited by examiner

AUTONOMOUSLY DRIVEN ROTARY STEERING SYSTEM

TECHNICAL FIELD

The present disclosure relates to systems and methods for rotary directional drilling.

BACKGROUND

To facilitate the drilling of non-linear wellbores, rotary steering systems may be deployed to steer the path of a drill bit along a desired are wellbore path. Such systems are configured to rotate while the drill string that includes the bit is being rotated. The rotary steering system (RSS) may be controlled by an operator, such as an engineer, who controls the system via a surface controller by using mud pulse telemetry or a similar method of communication. Commands generated by the surface controller may be received at an on board controller that is local to a steering subassembly to cause deflection of the drill bit in a desired direction (during rotation of the drill string) to complete the drilling operation.

BRIEF DESCRIPTION OF THE DRAWINGS

Illustrative embodiments of the present disclosure are described in detail below with reference to the attached drawing figures, which are incorporated by reference herein, and wherein.

Figure 1:
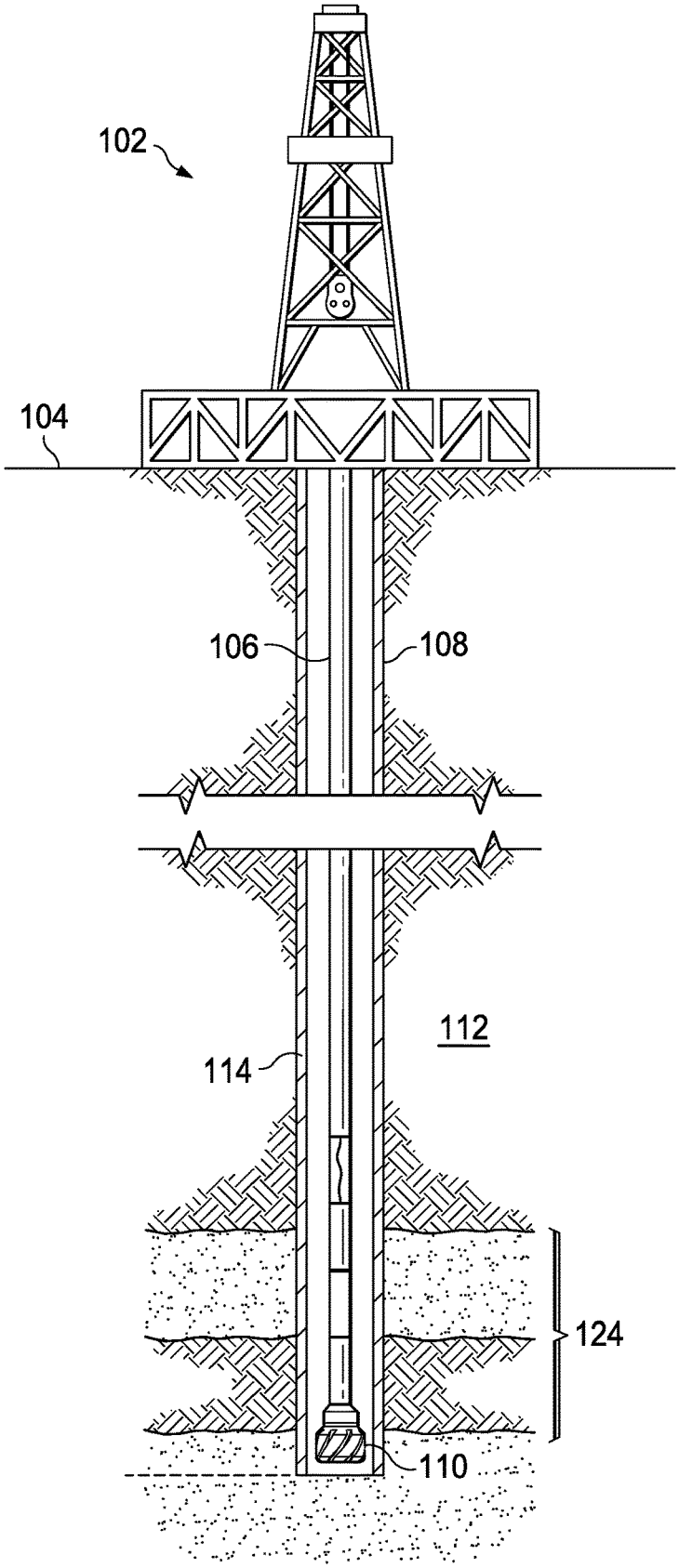
FIG. 1 is a schematic, side view of a wellsite having a borehole that extends into a subterranean formation.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical algorithmic changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The rotary steering system of this disclosure provides a mechanism for driving the counter-rotation of a geostationary valve of a rotary steering tool using a self-contained drive system that can operate autonomously. The system includes an electric machine operable to act as a downhole motor and as a generator. The machine is coupled to a turbine to provide efficient counter-rotation of the geostationary portion of the tool without the need for an external electrical power supply and, in cases in which the turbine may not supply an adequate rate of rotation, to apply electric power from the motor to augment the drive of the turbine.

Rotary steering systems are typically provided to direct a downhole drill bit in a desired direction while the drill string is being rotated for the purpose of controlling the path that a well bore follows. A rotary steering system includes a mechanism for measuring a reference direction with respect to gravity, and a mechanism for steering with respect to the measured direction. Typically, there will be a mechanical member of the rotary steering system that is held "geostationary" while rotating, which generally means that mechanical member is effectively non-rotating with respect to the formation while drilling even while other drill string components involved in driving rotation of the drill bit are rotating. The particular member that is held geostationary varies depending on the RSS design. In many rotary steering system systems, the geostationary member is external (e.g. an external housing) and has a mechanism to engage the well bore to prevent rotation. Other rotary steering system systems have an internal counter rotating mechanism that may be essentially equal and opposite the rotation of the drill string so that a counter-rotating component is effectively geostationary.

To accomplish controlled deflection of a drill bit in a non-linear drilling system, an exemplary rotary steering system may include steering pads or similar biasing mechanisms that exert a force against a portion of the wellbore wall and a portion of the rotary steering system as the drill bit continues to rotate. The deflection induced by the biasing mechanisms alters the trajectory of the drill bit in accordance with the commands received from the surface controller. The biasing mechanism may be one of several types, including a "push-the-bit" biasing mechanism that deflects the bit by exerting a force between the wellbore wall and a drive-shaft coupled to the bit.

A push-the-bit biasing mechanism may comprise, for example, a plurality of thrust pads that are controllably, radially extendable from the tool string to engage and exert a force against the wellbore wall that results in an opposing force being applied to the tool string. To facilitate operation of such thrust pads, certain components within the steering system are held stationary relative to the formation (i.e., "geostationary"). These components may be coupled to a geostationary portion of the tool string, and may include a counter-driven shaft and an upstream disk of a geostationary valve. As referenced herein, the term geostationary generally indicates that the referenced object is rotationally stationary relative to the earth even if it is in motion relative to an object to which it is affixed (e.g. by a bearing interface). To that end, the geostationary valve and driveshaft of the tool string may rotate counter the direction of rotation of the drill string at an angular velocity that is equal and opposite to the angular velocity of the portion of the drill string to which it is affixed. By making valve geostationary, the thrust pads may be operated to generate a vector force that is substantially constant relative to the formation (by extending on or more pads toward the formation in the same periodic interval as the pads rotate within the tool string) in order to produce controlled deflection of the drill bit.

To maintain a geostationary valve and driveshaft of the drill string with a net zero rotation relative to the formation, motion counter to the rotation of the drill string is generated resulting in a net zero rotation relative to the formation. In some embodiments, drilling fluid flow may be used to power a turbine or motor that counter rotates the geostationary valve and driveshaft of the rotary steering system. The drilling fluid flow is directed across a turbine or mud motor that turns in the target direction. Various devices, such as a continuously variable transmission, or electromagnetic clutches engaged to the counter rotating turbine may be used to adjust speed of the counter rotating member. However, in all of these devices the input flow rate is potentially affected by other fluctuating drilling parameters and may not provide a consistent source of power for a counter rotating member of the geostationary valve and driveshaft of the rotary steering system. Additionally, if the rotating motion of the drill string is not constant, which occurs during stick slip drilling conditions in a wellbore, the it may be difficult to maintain the desired target tool face (or direction in which the drill string is being steered at a given time) and, correspondingly, the desired direction of drilling.

The rotary steering system of this disclosure provides a mechanism for driving the counter-rotation of the geostationary portion of a rotary steering tool using a self-contained drive system. The system includes a downhole generator and turbine to provide efficient counter-rotation of the geostationary portion of the tool without the need for an external electrical power supply. In accordance with an illustrative embodiment, a rotary steering system leverages stored excess energy syphoned from the turbine to drive rotation of a geostationary portion of the rotary steering system. The system is thereby operable to provide a power boost when it is desirable to use more power to counter-rotate the geostationary portion than can be provided by the turbine. The system also provides for deceleration of the geostationary portion if it is desirable to counter-rotate the geostationary portion at a rate that is less than the rate of rotation that would be cause by the turbine.

Turning now to the figures, FIG. 1 shows a drilling rig 102 located at or above a surface 104. The drilling rig 102 includes a rotating drill string 106 that is shown extending into a wellbore 108. A drive system at the surface 104 causes rotation of the drill string 106, which includes a drill bit 110 that forms the wellbore 108 as the drill bit 110 penetrates a geological formation 112. The wellbore 108 may be uncased, or may include a casing 114 to reinforce the wall of the wellbore 108 and prevent the undesired ingress of fluid from the cased portions of the wellbore. The drill string 106 includes a rotary steering system 124 that is operable to induce lateral displacement of the drill bit 110 to alter the path the drill bit 110 follows as it forms the wellbore 108.

Figure 2:
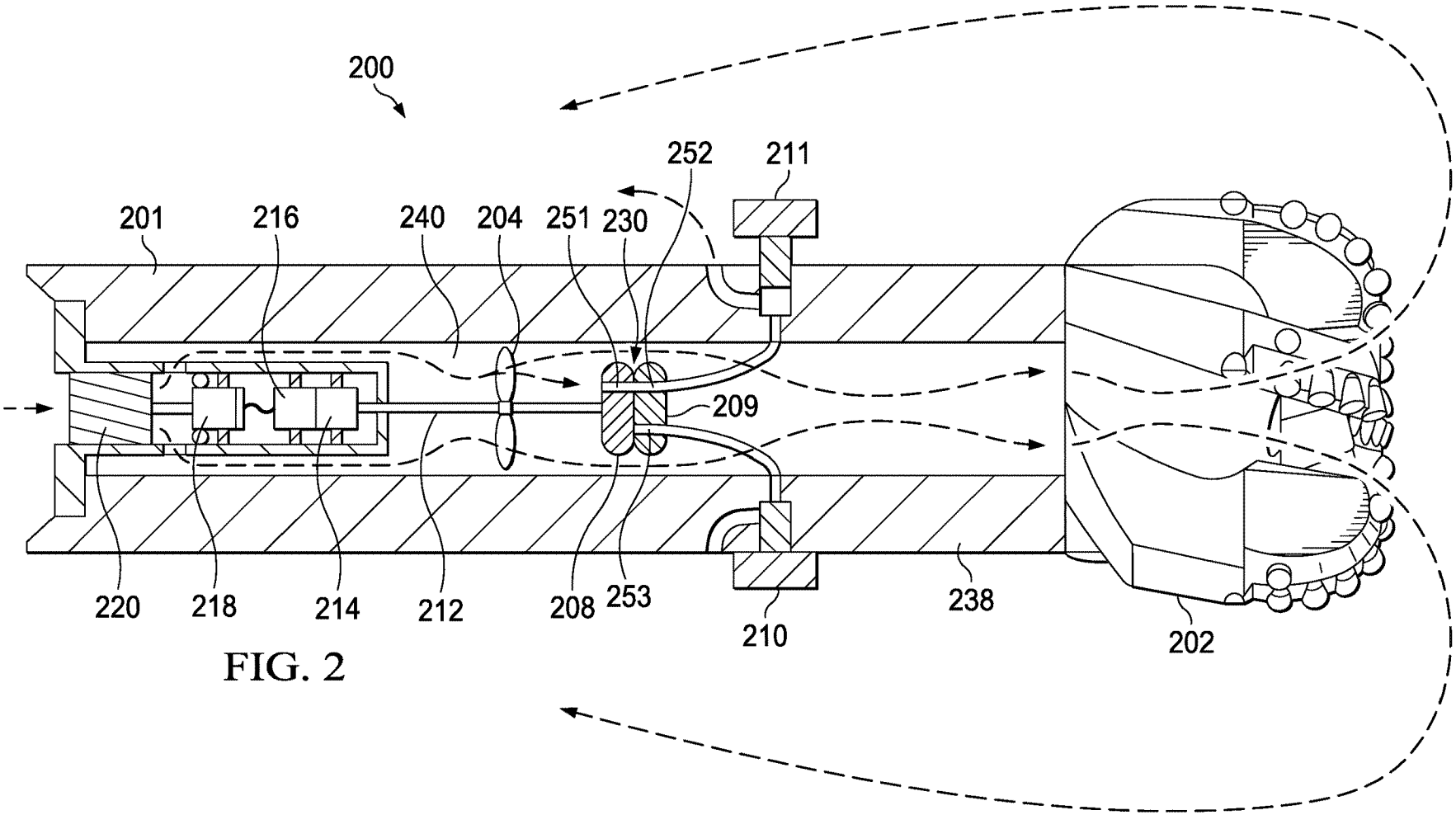
FIG. 2 is a schematic, side view, in partial cross-section, showing a rotary steering system subassembly.

FIG. 2 shows an example of a rotary steering system 200 in accordance with an embodiment of the present disclosure, and analogous to the rotary steering system 124 of FIG. 1. The rotary steering system 200 includes a tool housing 201 that includes a number of components, including a geostationary valve 230. The geostationary valve 230 may be a disk valve having a geostationary upper disk 208 and a lower disk 209 that rotates with the rotary steering system 200. The lower disk 209 of the geostationary valve 230 is rotationally coupled to a rotating bottom-hole assembly 238 that rotates a drill bit 202. Similarly, the upper disk 208 of the geostationary valve 230 is coupled to the driveshaft at an uphole interface of the rotary steering system 200. As referenced herein, "upper" generally refers to "uphole", or as taken along the path of the wellbore, closer to the surface. Correspondingly, "lower" generally refers to "downhole", or as taken along the path of the wellbore, further from the surface.

The lower disk 209 of the geostationary valve 230 includes valve ports, or apertures that are each fluidly coupled to a piston of a one of a plurality of thrust pad assemblies. The thrust pad assemblies include steering pads 210, 211, and are spaced circumferentially about the rotary steering system 200 to engage the wall of the wellbore and exert a lateral force on the rotary steering system 200 and, in turn, the drill bit 202. The steering pads 210, 211 may be actuated by the geostationary valve 230. In the illustration of FIG. 2, only two steering pads 210, 211 are shown for illustrative purposes. In many embodiments, however, the rotary steering system 200 includes three steering pads or more. During drilling, the upper disk 208 of the geostationary valve 230 is maintained in a substantially static orientation relative to the formation, while the lower disk 209 is permitted to rotate. As the lower disk rotates, a geostationary aperture 251 of the upper disk 208 is periodically aligned with rotating apertures 252, 253, thereby delivering fluid to the pistons of the thrust pad assemblies in succession. The steering pads 210, 211 are thereby actuated as steering tool 200 rotates, each time in the same rotational position to bias the steering tool in a desired direction.

To remain stationary relative to the formation, the upper disk 208 of the geostationary valve 230 is rotationally driven, relative to the rotating steering tool and bottomhole assembly 238 in the opposite rotational direction but at the same magnitude as the rate of rotation as the rotating tool and bottom-hole assembly 238. To facilitate such counter-rotation, the upper disk 208 of the geostationary valve 230 is coupled to a drive system via a drive shaft 212. The drive shaft 212 is coupled to a turbine 204 that is operable to rotate in response to drilling fluid being circulated through a central flow channel 240, or primary bore, of the rotary steering system 200. In some embodiments, the turbine 204 is coupled to the drive shaft 212 using an optional clutch interface that selectively engages the drive shaft 212 or that allows the turbine 204 to drive the drive shaft 212 in solely in a desired direction of rotation.

In some embodiments, the drive shaft 212 is also coupled to a generator 214, which is in turn coupled to a controller 216 and an energy store 218. The generator 214 may be an electric machine that is operate is a motor and as a generator. In some embodiments, the generator 214 includes a rotor and stator configuration and is operable to convert kinetic energy from fluid flow in the wellbore to storable electric energy. The generator 214 may also be actuated by the controller 216 to operate as a motor to drive the drive shaft 212 in a mode of operation in which the generator 214 converts stored electric energy into kinetic energy (e.g., rotation of the drive shaft 212). The drive shaft 212 may also be coupled via the controller 216 to a resistor 220 or similar structure that is operable to dissipate energy by heat transfer or otherwise. As such, the assembly that includes the generator 214 is operable to dissipate excess energy into the surrounding environment if the energy store 218 is at capacity and the drive shaft 212 continues to be driven by an external source, such as the turbine 204.

To facilitate the dissipation of excess energy, the controller 216 includes a processor and memory, and is operable to execute stored instructions to determine whether the energy store 218 has stored a threshold amount of energy. If the energy store 218 has stored the threshold amount of energy, the controller 216 is operable to divert any additional energy generated by the generator 214 to the resistor 220 for dissipation. Similarly, the controller 216 is operable to control the rate of rotation of the geostationary valve 230 over a range of operating states in which the geostationary valve 230 is (a) driven directly by the turbine 204 or (b) driven by the generator 214 when the generator 214 is controlled to operate as a motor. To that end, the controller 216 is operable to determine at a first time whether an augmentation condition exists at the rotary steering subassembly 200 and to actuate the generator 214 to act as a motor and augment rotation of the drive shaft 212 (and correspondingly the geostationary valve 230) by the generator 214 upon determining that the augmentation condition exists. As referenced herein, an augmentation condition may be any condition in which it is desirable to rotate the geostationary valve 230 at a rate of rotation that is greater than the rate of rotation caused by the turbine 204. Examples of such conditions include stick slip, torsional resonance, and reduced flow. In accordance with the foregoing, it is noted that the positioning of the turbine 204 downhole from the generator 214 may allow the generator 214 to consume less energy than alternative configurations.

The controller 216 also includes instructions and functionality to determine at a second time to again determine whether the augmentation condition exists at the steering subassembly, and to cease augmenting the rate of rotation of the drive shaft 212 using the generator 214 upon determining that the augmentation condition no longer exists. The controller 216 also includes instructions and functionality to determine at the second time (or a later third time) whether the rate of rotation is faster than desired. In such an instance, the controller 216 may determine that a braking condition exists, and the controller 216 may actuate the generator 214 to act as a brake upon determining that the braking exists.

Figure 3:
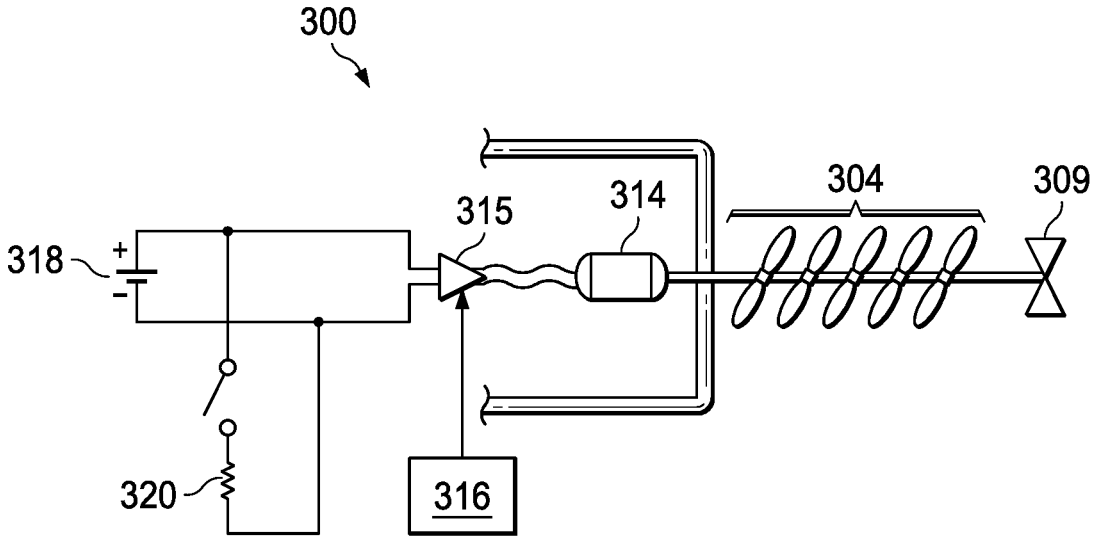
FIG. 3 is a schematic diagram of the rotary steering system of FIG. 2.

FIG. 3 shows a schematic diagram of the rotary steering system of FIG. 2. The representative steering system 300 includes a valve 309, which effectively represents the geostationary portion described previously. The valve 309 is mechanically coupled to a turbine 304 that is operable to rotate the valve 309. The turbine 304 is, in turn, mechanically coupled to a motor/generator 314, which is operable to act as a brake to slow down the turbine 304 and, correspondingly, the valve 309. Alternatively, the motor/generator 314 is operable to drive the valve 309 at a rate that is faster than the rate of rotation cause by the turbine 304. The motor/generator is communicatively coupled to a controller 316, and mechanically coupled to an inverter 315 that converts energy from the generator to a direct current of electrical energy. The electrical energy may be stored by an energy store, which is shown as a capacitor or battery 318, or dissipated by a chopper circuit or electrical brake, shown as resistor 320.

In operation, (referring again to FIG. 2) the geostationary valve 230 is used to actuate the rotary steering system by directing hydraulic power (via mudflow) to pistons that actuate the steering pads 210, 211 positioned about the outer circumference of the steering system. The geostationary valve 230 is maintained in a static or angular static condition relative to the wellbore wall by rotating the geostationary valve 230 at the same speed as, but in the opposite direction of, the rotating drill string. The power used to rotate the geostationary valve 230 is harnessed from the turbine 204 which is turned by mudflow through the central flow channel 240 of the rotary steering subassembly 200, and the rate of rotation is controlled by the controller 216 that moderates or augments the rate of rotation by moderating the current flow through the generator 214.

In some embodiments, to ensure that the turbine 204 can power the geostationary valve 230 at the necessary speeds, the turbine 204 is designed to continuously provide more energy than is needed under normal conditions. This excess energy allows the generator 214 to draw off and convert excess turbine energy to electrical energy, and to store the electrical energy at the energy store 218. Energy in excess of what the energy store 218 can store is drained off through the resistor 220, which may be a switched resistor circuit (chopper circuit) that acts as an electrical brake and dissipates the excess energy as heat into the surrounding drilling fluid.

Under conditions of slipstick, torsional resonance in the drilling string, or low flow, it may be desirable to rotate the geostationary valve 230 at a faster rate of rotation than can be accomplished using only the turbine 204. In such a circumstance, the controller 216 directs stored energy back to the generator 214 from the energy store 218 to provide the extra power needed to rotate the geostationary valve 230. Conversely, when it is desirable to slow down the rate of rotation of the geostationary valve 230, the generator 214 operates as a brake by drawing energy from the turbine 204 and storing or dissipating the excess energy as described previously.

In accordance with an illustrative embodiment, a method of operating the rotary steering subassembly 200 includes rotating a rotary drilling subassembly at a first rate of rotation and rotating a geostationary valve 230 of the rotary steering subassembly 200 at a second rate of rotation. The second rate of rotation is equivalent to, but in the opposite direction of, the first rate of rotation, thereby rendering the geostationary valve 230 rotationally static relative to the wellbore wall. Rotating the geostationary valve 230 is accomplished using the turbine 204, which is powered by fluid flow across the turbine 204. The geostationary valve 230 is controlled to actuate the steering pad subassemblies 210, 211 at the same angular location as they rotate about the drill string to direct the drill bit. In such an embodiment, the rotary drilling subassembly includes the turbine 204, the valve subassembly 208, the motor/generator subassembly (generator 214) coupled to the turbine 204, the controller 216 communicatively coupled to the generator 214, and the energy store 218. The illustrative method may further include operating the generator 214 to transmit energy to the energy store 218.

In some embodiments, the method includes operating the controller 216 to determine whether the energy store 218 has stored a threshold amount of energy, and diverting any additional energy generated by the generator 214 to a resistor 220 upon determining that the energy store 218 has stored the threshold amount of energy. The method may further include determining at a first time whether an augmentation condition exists at the steering subassembly and decoupling a rate of rotation of the geostationary valve 230 from a rate of rotation of the turbine 204 and rotating the geostationary valve 230 at a second rate of rotation using the generator 214 upon determining that the augmentation condition exists. As noted previously, examples of augmentation conditions include stick slip, torsional resonance, and low flow. The illustrative method of may also include determining at a second time whether the augmentation condition exists at the steering subassembly and, upon determining that the augmentation condition does not exist, decoupling the rate of rotation of the geostationary valve 230 from the generator 214 and rotating the geostationary valve 230 using the turbine 204.

Figure 4:
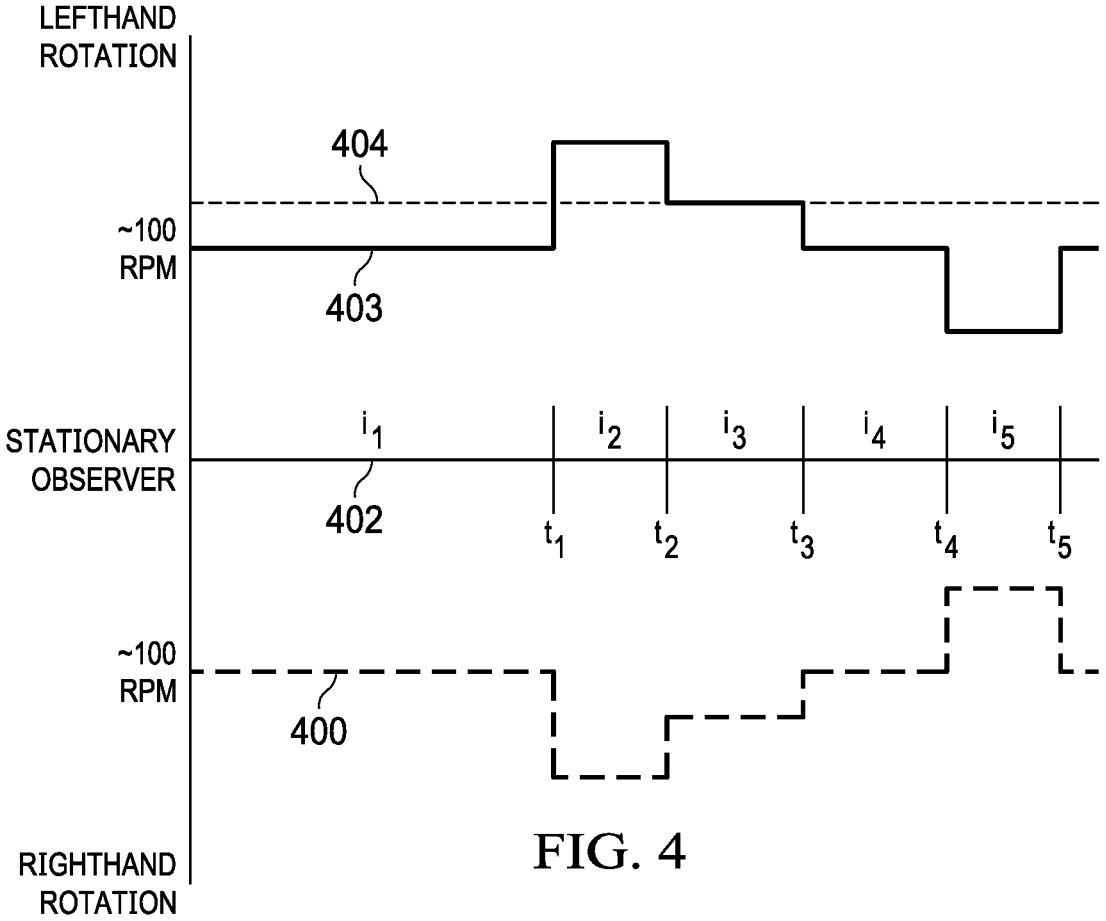
FIG. 4 is a chart showing representative operating characteristics of a driven valve in accordance with an embodiment of the present disclosure.

In accordance with the foregoing systems and methods, several illustrative operating states are described with regard to FIG. 4. FIG. 4 illustrates several rates of rotation, relative to a baseline 402, which is rotationally static relative to a formation in which the system is deployed. Drillstring curve 400 shows the right-hand rate or rotation that corresponds to operation of the drillstring. The drillstring curve 400 indicates that the drillstring operates at (by way of example) 100 rpm in a default state at a first time ($T_1$). The rate of rotation of the drillstring speeds up at a second time ($T_2$), decelerates at successive third, fourth, and fifth times ($T_3$, $T_4$, and $T_5$), and accelerates again at a sixth time ($T_6$). The representative turbine curve 404 illustrates that, assuming a steady state of mud flow across the turbine, the turbine is operable to rotate at approximately 110 rpm (left-hand) relative to the drillstring. The geostationary valve curve 403 illustrates the rate of rotation of the above-described geostationary valve, also relative to the drillstring. The valve curve 403 indicates that the geostationary valve accelerates and decelerates with the drillstring, and therefore does not always operate at the same rate of rotation as the turbine. To that end, the delta between the valve curve 403 and the turbine curve 404 shows that an illustrative system may experience the following operating states: (1) over a first time interval ($i_1$) between $T_1$ and $T_2$, the generator limits turbine speed and the system is able to store excess energy by directing the excess energy to the energy store; (2) over a second time interval ($i_2$) between $T_2$ and $T_3$, drillstring rotation speeds up beyond turbine capacity; (3) over a third time interval ($i_3$) between $T_3$ and $T_4$, the drillstring rotation decreases to the rate of counter-rotation of the turbine, and the turbine is able to drive the valve in free rotation, with no energy being directed to or received from the generator; (4) over a fourth time interval ($i_4$) between $T_4$ and $T_5$, the drillstring rate of rotation decreases again and the operating state returns to the operating state of the first time interval ($i_1$); and (5) over a fifth time interval ($i_5$) between $T_5$ and $T_6$, the drillstring rate of rotation decreases further such that braking is required, and the generator is operated as a brake to direct excess energy to the energy store and/or resistive circuit to maintain the valve is a rotationally static state relative to the formation.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, disclosed processes may be performed in parallel or out of sequence, or combined into a compound process. The scope of the claims is intended to broadly cover the disclosed embodiments and any such modification. Further, the following clauses represent additional embodiments of the disclosure and should be considered within the scope of the disclosure:

In an illustrative embodiment, a method of operating a rotary drilling subassembly includes rotating the rotary drilling subassembly at a first rate of rotation and rotating a valve subassembly at a second rate of rotation. The second rate of rotation is equivalent to, but in the opposite direction of, the first rate of rotation. Rotating the valve subassembly includes rotating the valve subassembly using a turbine powered by fluid flow across the turbine at an initial time. Additionally, the valve subassembly includes a valve coupled to a steering pad subassembly, the referenced rotary drilling subassembly includes the turbine, the valve subassembly, a motor subassembly coupled to the turbine, a controller communicatively coupled to the motor subassembly, and a power source. The motor may include functionality to operate as a generator, and may thereby be operable to transmit energy to the power source.

In some embodiments, the controller is operable to determine whether the power source has stored a threshold amount of energy, and to divert any additional energy generated by the generator to a resistor circuit coupled to the power source upon determining that the power source has stored the threshold amount of energy. In some embodiments, the method further includes determining at a first time (after the initial time) whether an augmentation condition exists at the rotary steering subassembly and increasing a rate of rotation of the valve subassembly using the motor subassembly upon determining that the augmentation condition exists. The augmentation condition may be, for example, stick slip or torsional resonance. The method may further include determining at a second time whether the augmentation condition exists at the rotary steering subassembly, the second time being later than the first time, and, upon determining that the augmentation condition does not exist, deactivating the motor subassembly and rotating the valve subassembly at the second rate of rotation using the turbine.

In some illustrative embodiments, a rotary steering subassembly includes a valve subassembly and a turbine rotationally coupled to the valve subassembly. The valve subassembly includes a valve coupled to a steering pad subassembly. In turn, the rotary drilling subassembly includes the turbine, the valve subassembly, a motor subassembly coupled to the turbine, a controller communicatively coupled to the motor subassembly, and a power source. In some embodiments, the motor includes or is operable to function as a generator that is operable to transmit energy to the power source.

The controller may be operable to determine whether the power source has stored a threshold amount of energy, and to divert any additional energy generated by the generator to a resistor circuit coupled to the power source upon determining that the power source has stored the threshold amount of energy. In some embodiments, the controller is operable to determine at a first time whether an augmentation condition exists at the rotary steering subassembly and to initiate control of rotation of the valve subassembly by the motor subassembly upon determining that the augmentation condition exists. The controller may be further operable to determine at a second time whether the augmentation condition exists at the rotary steering subassembly, and to cease augmenting a rate of rotation of the valve subassembly using the motor upon determining that the augmentation condition does not exist, wherein the second time is later than the first time.

In some exemplary embodiments, a downhole drilling system includes a rotary steering subassembly having a valve subassembly a plurality of steering thrust pads actuated by the valve, a turbine rotationally coupled to the valve subassembly, an electric machine coupled to the turbine by a driveshaft, and a controller communicatively coupled to the electric machine and a battery. The system also includes a bottom-hole assembly comprising a drill bit and being coupled to the rotary steering subassembly such that the plurality of steering thrust pads are operable to transmit a radial force to the drill bit to direct a direction of drilling of the downhole drilling system. The controller is operable to actuate the electric machine to transmit energy to the battery.

In some embodiments, the controller is operable to determine whether the battery has stored a threshold amount of energy, and to divert any additional energy generated by the electric machine to a resistor circuit coupled to the electric machine upon determining that the battery has stored the threshold amount of energy. The controller may also be operable to determine at a first time whether an augmentation condition exists at the rotary steering subassembly and initiate control of rotation of the valve subassembly by the electric machine upon determining that the augmentation condition exists. In addition, the controller may be operable to determine at a second time (later than the first time) whether the augmentation condition exists at the rotary steering subassembly, and to initiate control of rotation of the valve subassembly by the turbine upon determining that the augmentation condition does not exist.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A method of operating a rotary steering subassembly, the method comprising:

rotating a tool housing of the rotary steering subassembly at a first rate of rotation;

flowing drilling fluid through a turbine to rotate an upper disk of a valve subassembly at a second rate of rotation relative to the tool housing, wherein the second rate of rotation is substantially equivalent to, but in the opposite direction of, the first rate of rotation;

driving an electric machine with the turbine to convert kinetic energy from the turbine to electric energy for storage by a power source;

determining at a first time whether an augmentation condition exists at the rotary steering subassembly and increasing a rate of rotation of the valve subassembly using the electric machine upon determining that the augmentation condition exists; and determining at a second time whether the augmentation condition exists at the rotary steering subassembly, the second time being later than the first time, and, upon determining that the augmentation condition does not exist, deactivating the electric machine subassembly and rotating the valve subassembly at the second rate of rotation using the turbine.

2. The method of claim 1, wherein the rotary drilling subassembly further comprises a controller communicatively coupled to the electric machine, the method further comprising determining at the controller whether the magnitude of the second rate of rotation of the upper disk exceeds the magnitude of the first rate of rotation of the tool housing, and activating the electric machine subassembly as a brake upon determining that the magnitude of the second rate of rotation of the upper disk exceeds the magnitude of the first rate of rotation of the tool housing.

3. The method of claim 1, wherein the rotary drilling subassembly further comprises a controller and a power source communicatively coupled to the controller and electrically coupled to the electric machine, the method further comprising determining at the controller whether the power source has stored a threshold amount of energy, and diverting any additional energy generated by the electric machine to a resistor circuit coupled to the power source upon determining that the power source has stored the threshold amount of energy.

4. The method of claim 1, wherein the augmentation condition comprises stick slip.

5. The method of claim 1, wherein the augmentation condition comprises torsional resonance.

6. The method of claim 1, wherein the rotary steering subassembly further comprises a thrust pad assembly.

7. The method of claim 1, wherein the rotary steering subassembly further comprises a driveshaft coupled to the upper disk.

8. The method of claim 1, wherein the lower disk comprises a valve port.

9. A rotary steering subassembly comprising:

a tool housing;

a valve subassembly positioned within the tool housing and comprising an upper disk and a lower disk, the lower disk being fluidly coupled to a plurality of steering pad subassemblies and rotationally coupled to the tool housing;

a turbine rotationally coupled to the upper disk of the valve subassembly; and an electric machine subassembly coupled to the turbine by a drive shaft, the electric machine subassembly comprising a motor and a generator being coupled to a power source and a controller; wherein the electric machine subassembly is electrically coupled to the power source and is operable to transmit electrical energy to, and receive electrical energy from, the power source; wherein the controller is operable to determine at a first time whether an augmentation condition exists at the rotary steering subassembly and to initiate control of rotation of the valve subassembly by the electric machine subassembly upon determining that the augmentation condition exists; wherein the controller is further operable to determine at a second time whether the augmentation condition exists at the rotary steering subassembly, and to cease augmenting a rate of rotation of the valve subassembly using the electric machine subassembly upon determining that the augmentation condition does not exist, wherein the second time is later than the first time.

10. The rotary steering subassembly of claim 9, wherein the controller is operable to determine whether the power source has stored a threshold amount of energy, and to divert any additional energy generated by the electric machine subassembly to a resistor circuit coupled to the power source upon determining that the power source has stored the threshold amount of energy.

11. The rotary steering subassembly of claim 9, wherein the augmentation condition comprises stick slip.

12. The rotary steering subassembly of claim 9, wherein the augmentation condition comprises torsional resonance.

13. The rotary steering subassembly of claim 9, wherein the rotary steering subassembly further comprises a thrust pad assembly.

14. The rotary steering subassembly of claim 9, wherein the rotary steering subassembly further comprises a driveshaft coupled to the upper disk.

15. A downhole drilling system comprising:

a rotary steering subassembly comprising a valve subassembly positioned within a tool housing and comprising an upper disk and a lower disk, the lower disk being fluidly coupled to a plurality of steering pad subassemblies and rotationally coupled to the tool housing, a turbine rotationally coupled to the upper disk of the valve subassembly, and an electric machine subassembly coupled to the turbine by a drive shaft, the electric machine subassembly comprising a motor and a generator being coupled to a battery and a controller;

a bottom-hole assembly comprising a drill bit and being coupled to the rotary steering subassembly such that the plurality of steering thrust pads are operable to transmit a radial force to the drill bit to direct a direction of drilling of the downhole drilling system;

wherein the controller is operable to determine at a first time whether an augmentation condition exists at the rotary steering subassembly and initiate control of rotation of the valve subassembly by the electric machine upon determine that the augmentation condition exists; and wherein the controller is further operable to determine at a second time whether the augmentation condition exists at the rotary steering subassembly, and to initiate control of rotation of the valve subassembly by the turbine upon determining that the augmentation condition does not exist, wherein the second time is later than the first time.

16. The downhole drilling system of claim 15, wherein the controller is operable to actuate the electric machine to transmit energy to the battery.

17. The downhole drilling system of claim 15, wherein the controller is operable to determine whether the battery has stored a threshold amount of energy, and to divert any additional energy generated by the electric machine to a resistor circuit coupled to the electric machine upon determining that the battery has stored the threshold amount of energy.

18. The downhole drilling system of claim 15, wherein the augmentation condition consists of one of stick slip and torsional resonance.

19. The downhole drilling system of claim 15, wherein the rotary steering subassembly further comprises a thrust pad assembly.

20. The downhole drilling system of claim 15, wherein the rotary steering subassembly further comprises a driveshaft coupled to the upper disk.

* * * * *